US006667071B2

(12) United States Patent
Baumlin et al.

(10) Patent No.: US 6,667,071 B2
(45) Date of Patent: Dec. 23, 2003

(54) METHOD OF COATING A LIQUID FILM ON A SUPPORT

(75) Inventors: Jean-Marie Baumlin, Chalon sur Saone (FR); Aurore J. Calmels, Givry (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/134,111

(22) Filed: Apr. 29, 2002

(65) Prior Publication Data

US 2003/0008064 A1 Jan. 9, 2003

(30) Foreign Application Priority Data

Jun. 20, 2001 (FR) ..... 01 08156

(51) Int. Cl.[7] ..... B05D 3/14
(52) U.S. Cl. ..... 427/10; 427/9

(58) Field of Search ..... 427/9, 10

(56) References Cited

PUBLICATIONS

"Physical Chemistry of Surfaces" Arthur W. Adamson, 1960 Interscience Publishers, Inc., pp. 122–123. ( No month avail. ).
"Surfactants" Chantal Larpent, pp. K342–1–K342–13. ( No date avail. ).
"Research Disclosure" Sep. 1996, pp. 598–601.
"Research Disclosure" Sep. 1994, pp. 517–518.
"Research Disclosure" Sep. 1996, pp. 612–613.
"Research Disclosure" Sep. 1996, pp. 627–629.

*Primary Examiner*—Bernard Pianalto
(74) *Attorney, Agent, or Firm*—Clyde E. Bailey, Sr.

(57) ABSTRACT

A method of coating a support with a liquid composition having an aqueous or an organic solvent and a surfactant eliminates defects in the coated layer. Temperature gradients between successive zones of the coating layer are eliminated by the application of coating having a preselected surfactant.

10 Claims, 1 Drawing Sheet

METHOD OF COATING A LIQUID FILM ON A SUPPORT

FIELD OF THE INVENTION

The invention relates to a method of coating a substrate or support. More particularly, the invention concerns a method of coating a substrate or support with a liquid film in a manner that minimizes defects due to temperature gradients in the liquid film during coating.

BACKGROUND OF THE INVENTION

When a liquid composition is coated on a support to form a film, the support is most often driven in movement along its longitudinal axis on conveyer rollers. From that moment, the layer formed on the support is subject to temperature gradients induced by the conveyor equipment or by the evaporation of the solvent of the liquid composition. In other words, temperature variations are observed from one point to another of the layer formed in the direction of conveyance. As the surface tension varies according to temperature, this gradient causes variations of surface tension and surface stresses. These surface stresses induce movements in the layer, known as the Marangoni effect. The Marangoni effect is described in "Physical Chemistry of Surfaces" by Arthur W. Adamson published by John Wiley & Sons, page 122. This movement in the layer, extending from a point where the temperature is high (weak surface tension) to a point where the temperature is low (high surface tension), generates many defects (lines, stripes, agglomerates, etc.). Some surfactants enable these defects to be minimized. However, assessment of the efficiency of a surfactant to minimize these defects is not easy. It cannot be done with simple measurements of surface tension.

Therefore, it is desirable in the art to have a method of coating a support with a liquid film that includes identification and selection of a suitable surfactant that minimizes coating defects due to temperature gradients in the liquid film.

SUMMARY OF THE INVENTION

It is, therefore, an object of the present invention to provide a method for coating a support with a liquid composition comprising an aqueous or organic solvent and at least a surfactant.

Another object of the invention is to provide a method for selecting a surfactant for a coating composition comprising an aqueous or an organic solvent and at least a surfactant.

Yet another object of the invention is to provide a method for determining the optimum concentration of a surfactant to be used in a coating composition having an aqueous or an organic solvent component and at least a surfactant component to minimize coating defects due to a temperature gradient.

These objects and others are achieved by the present invention which relates to a method for coating a support with a layer of a composition comprising an aqueous or an organic solvent and at least a surfactant, wherein said surfactant agent has been selected by a sequence comprising the steps of: a) after formation of said layer, applying temperatures Ti to n successive zones $Z_n$ of said layer so that a temperature gradient $\Delta T$ is created between a zone $Z_i$ and a zone $Z_{i+1}$ and the temperatures of the zones $Z_i$ and $Z_{i+2}$ are the same, wherein n is an integer representing the number of zones, i is an integer between 1 and n, and $\Delta T$ is chosen so as to create a measurable periodic variation of thickness of said layer from the $1^{st}$ to the $n^{th}$ zone; b) measuring said thickness $H_x$ of each zone; c) determining an average variation of said thickness $\Delta H_m$ of said layer; and d) repeating steps (a) to (c) for a control composition comprising said aqueous or said organic solvent to determine $\Delta H_m$, wherein said surfactant satisfies the following condition: $\Delta H_m$ of said layer with said surfactant $<\Delta H_m$ for said control.

In another aspect of the invention, a method for selecting a surfactant for coating a support with a layer of a composition comprising an aqueous or an organic solvent and at least a surfactant, comprising the following steps: a) coating said support with said composition; b) after formation of said layer, applying temperatures Ti to n successive zones $Z_n$ of said layer, so that a temperature gradient $\Delta T$ is created between a zone $Z_i$ and a zone $Z_{i+1}$ and said temperatures of said zones $Z_i$ and $Z_{i+2}$ are the same, wherein n is an integer representing the number of zones, i is an integer between 1 and n, and $\Delta T$ is chosen so as to create a measurable periodic variation of thickness of said layer from the $1^{st}$ to the $n^{th}$ zone; c) measuring said thickness $H_x$ of each zone; d) determining an average variation of said thickness $\Delta H_m$ of said layer; and e) repeating steps (a) to (d) for a control composition comprising said aqueous or said organic solvent, to determine $\Delta H_m$ for said control, wherein said surfactant satisfies the following condition: $\Delta H_m$ of the layer with the surfactant $<\Delta H_m$ for the control.

in yet another aspect of the invention, a method of determining optimum concentration of a surfactant in a composition used for coating a layer on a support, said composition comprising an aqueous or an organic solvent, said method comprising the steps of: a) providing m coating compositions, with m being an integer >1, each coating composition having a different concentration of said surfactant; b) coating said each coating composition on a support and one composition per support, to obtain m separate coated supports; c) after formation of each layer, applying temperatures Ti to n successive zones Z of said each layer, so that a temperature gradient $\Delta T$ is created between a zone $Z_i$ and a zone $Z_{i+1}$ and said temperatures of the zones $Z_i$ and $Z_{i+2}$ are the same, n being an integer, i being an integer between 1 and n, and $\Delta T$ being chosen so as to create a measurable periodic variation of thickness of each layer from the $1^{st}$ to the $n^{th}$ zone; d) measuring said thickness $H_x$ of said each zone, and e) determining average variation of said thickness $\Delta H_m$ of said each layer, an optimum concentration of said surfactant being that of said layer which has the lowest average thickness variation $\Delta H_m$.

The present invention, therefore, has numerous advantageous effects over prior art developments including its ability to minimize defects in the coated support when the coating composition undergoes a temperature gradient during coating.

BRIEF DESCRIPTION OF THE DRAWINGS

The foregoing as well as other objects, features and advantages of this invention will become more apparent from the appended Figure, wherein:

The FIGURE is a schematic view of a device to carry out the method of the invention.

DETAILED DESCRIPTION OF THE INVENTION

Figure 1:
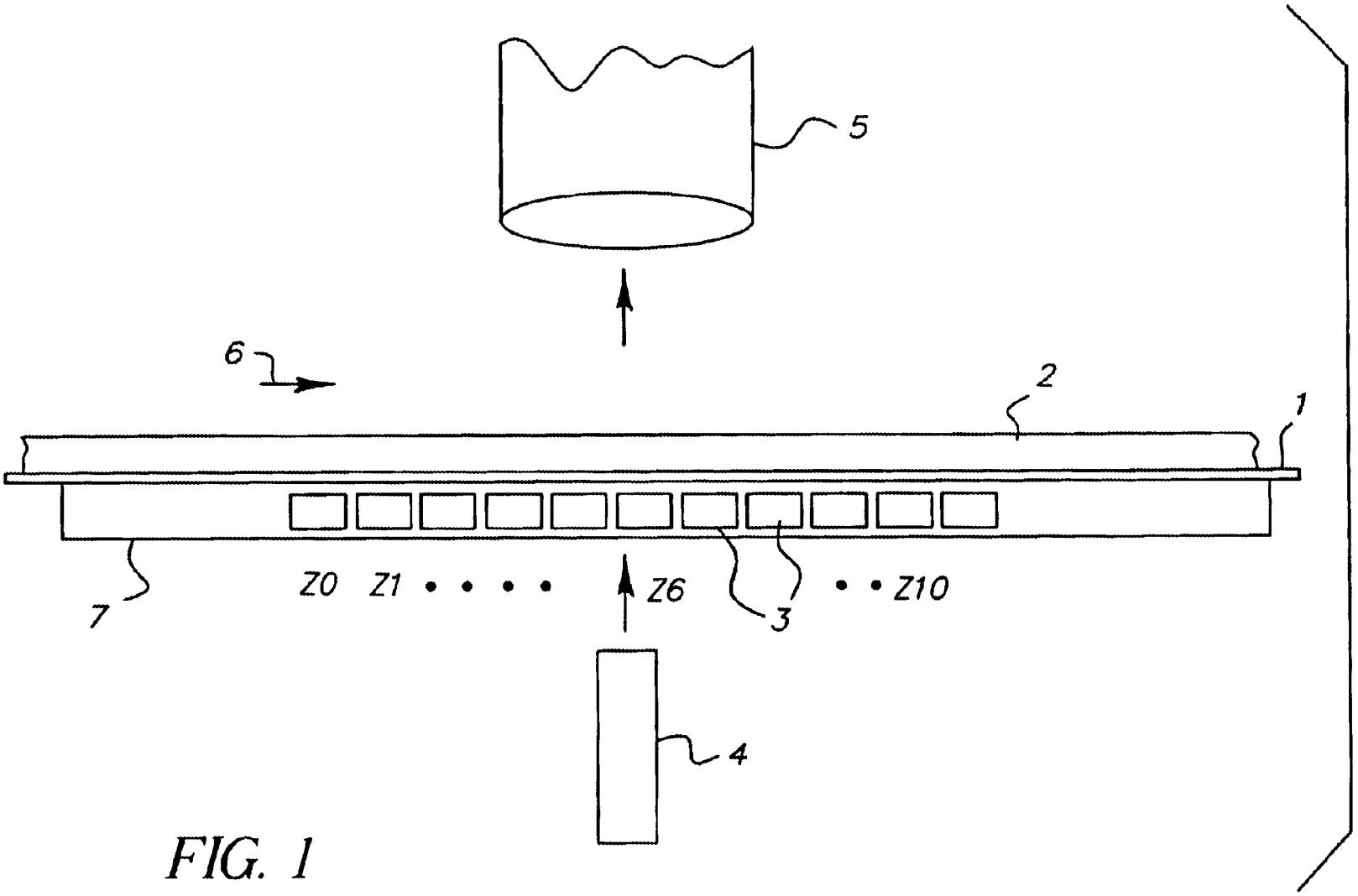

Turning now to the drawings, and in particular to FIG. 1, according to one preferred embodiment of the invention, a coating layer 2 deposited on a support 1 has a number of zones, denoted by $Z_n$, corresponding to temperature gradients $\Delta T$ in the coating layer 2. Generally, the number of such zones is more than 5, and preferably in the range of 8 to 15, as described in greater details below.

According to a particular embodiment of the invention, the composition comprises at least one optically absorbent substance and the thickness $H_x$ of each zone is measured by optical devices by illuminating the zones with a light source.

The term "surfactant" designates a substance that acts at an interface, in particular at the surface of a liquid (interface with air). The effect of a surfactant compound, even at low concentration, is to lower the liquid's surface tension. This property is responsible for the wetting, dispersion, detergency and emulsification phenomena of surfactant compounds. The other important property of a surfactant is self-aggregation in solution or micellization that governs the properties of solubilization and micro-emulsification. These two essential properties of a surfactant compound determine its application areas. Surfactant molecules have two parts with different polarities:

- an apolar part constituted by one or more aliphatic, linear or ramified, or aromatic hydrocarbon chains that are called the hydrophobic or lipophilic part, and
- a polar part constituted by one or more polar, ionic or non-ionic groups that are called the hydrophilic part. Examples of surfactants are given in "Surfactants", by C. Larpent, Techniques de l'Ingénieur, June 1995, vol. K 342, page 7 to 13, or in "Research Disclosure," September 1996, No. 38957, Chapter IX-A "Coating aids". The concentration of surfactant in the composition is generally in the range of from 0.01 to 5 weight percent and more advantageously from 0.1 to 3 weight percent, based on the total weight of the composition.

The invention can be implemented using conventional coating techniques such as, for example, curtain or bead coating. The support 1 is preferably driven in movement along its longitudinal axis. All these coating techniques have been the subject of many publications in the literature and, thus require no additional description.

When the support 1 is transparent and the coating layer 2 comprises an optically absorbing substance, the thickness of each zone ($Z_n$) of the coating layer 2 can be determined by the optical density using a spectrophotometer that emits a beam of monochromatic waves crossing the zone ($Z_n$) of the coating layer 2 to be measured. Thickness variations of the coating layer 2 containing an optically absorbent substance cause a variation of the optical density in the zone ($Z_n$) where the thickness has varied and thus enables determination of the thickness of the coating layer 2 in the relevant zone ($Z_n$). Light sources are chosen according to the optical technique used to measure the thickness of the coating layer 2 in each zone ($Z_n$). For example, if the technique combining an ellipsometer and a reflectometer is used, the light source is a laser. In this technique, the light coming from the laser is reflected on the zone ($Z_n$) to be measured and analyzed by an ellipsometer-reflectometer.

Alternatively, the thickness $H_x$ of each zone ($Z_n$) of the coating layer 2, when the coating layer 2 comprises an optically absorbing substance and when the support 1 is transparent, can be determined by the transmission optical density of each zone ($Z_n$) using a camera equipped with a photosensitive sensor of the charge-coupled device type. The charge-coupled device usually known by the acronym CCD, is a photosensitive sensor comprising light-sensitive cells (called pixels). During the exposure to the light source, the upper layer of each pixel transforms the photon into an electron. At the end of exposure, each pixel will have accumulated a number of electrical charges proportional to the quantity of light it has received. By transfer, these charges generate an output signal (voltage) that is amplified and digitized, i.e. an analog signal is converted into a digital signal. Analog/digital conversion can vary according to the type of CCD sensor. Available values are 256 (8 bits), 4096 (12 bits) or 65536 (16 bits) gray levels. The digitized signal is transmitted to a computer and saved as a file in the mass memory of the machine to constitute an image. The corrected image can be calculated according to the equation:

$$\text{Corrected image}=[(\text{raw image}-\text{noise image})/(\text{reference image}-\text{noise image})]\times(\text{average value of the raw image}). \quad \text{(Equation 1)}$$

"The noise image" only comprises the apparatus's electronic background noise signal. "The raw image" is the signal resulting from the support, the formed layer, the background noise due to the apparatus's electronics and the devices used to convey the film and create the temperature gradient. "The reference image" is the signal resulting from the support, the background noise due to the apparatus's electronics, and the devices used to convey the film and create the temperature difference. For each zone, the average profile is determined, also called the camera response (abbreviation: Rep). The average profile is determined by the equation:

$$\text{Average profile}=(\Sigma\ \text{corrected images})/\text{number of points} \quad \text{(Equation 2)}$$

The thickness of the layer is given by the equation:

$$H_x=\log(\text{Rep})\times C_a+C_b \quad \text{(Equation 3)}$$

$C_a$ and $C_b$ are constants that are determined for each composition by sampling that consists in measuring the camera response for uniform layers not having been subject to temperature variation and whose thickness is known. Thus the average thickness variation $\Delta H_m$ can be calculated.

The optically absorbing substances are preferably organic or inorganic dyes. Such dyes are for instance described in Research Disclosure, September 1994, No. 36544, Chapter VIII.

The invention is particularly advantageous when the composition to be coated comprises a polymer type binder, preferably when the binder is chosen from among the binders used in silver halide photographic products. Examples of binders for photographic use are given in "Research Disclosure," September 1996, No. 38957, Chapter II-A.

According to one particular embodiment, the support 1 is chosen from among the supports used in silver halide photographic products. Examples of supports for photographic products are given in "Research Disclosure," September 1996, No. 38957, Chapter XV.

According to another embodiment, the temperature difference $\Delta T$ is preferably more than or equal to 3° C. when the composition comprises mostly an organic solvent, and is more than or equal to 6° C. when the said composition comprises mostly an aqueous solvent.

The coating layer 2 resulting from the coating has a thickness usually between 40 and 400 $\mu$m in the wet state, i.e. before drying.

In the description that follows, reference will be made to FIG. 1 that schematically represents a preferred device to implement the methods of the invention. The device comprises:

a) a coating means to form a coating layer 2 from a composition comprising an aqueous or organic solvent and at least a surfactant, and apply this coating layer 2 onto a support 1;

b) a means 3 to apply the required temperature to the n successive zones $Z_n$ of the said layer; and c) a means to measure the thicknesses $H_x$ of each zone $Z_n$.

The means to measure the thicknesses $H_x$ of each zone $Z_n$ comprises means 3 to illuminate the zones $Z_n$, and optical detection means 5. The optical detection units (5) are preferably constituted of a photosensitive sensor of the charge-coupled device type. The device represented comprises a means 3 to apply the required temperature to the n successive zones n of the layer. The means 3 is constituted by channels placed in series under the support 1, in which flows a fluid maintained at the required temperature for the said zone. The coating means is not shown. The coating layer 2 is formed from the coating on a transparent support 1, which is driven in movement along its longitudinal axis 6, of a composition, comprising an aqueous or organic solvent, at least a surfactant and at least an optically absorbent substance. Using the 11 channels of the means 3, supported by a transparent plate 7, the temperature difference AT is created between zones $Z_i$ and $Z_{i+1}$, that generates a periodic variation (not shown) of the thickness of the coating layer 2 from zone $Z_0$ to zone $Z_{10}$ by movement of matter due to the Marangoni effect. Means to illuminate 4, such as a light source, is used to illuminate the zones $Z_0$ to $Z_{10}$ and the transmission signal is recorded using an optical detection means, for example, a camera 5 having a CCD sensor in order to determine the thickness variation $\Delta H_m$.

The invention is described in detail in the following examples.

EXAMPLES

Example 1

Two compositions were prepared:

Composition (A) with the following formulation (% by weight):
- 5.5% gelatin (type IV),
- 0.4% Alizarin Sapphire (Dye),
- 1% saponin,
- 1 l osmosed water.

Composition (B), used as control, with the following formulation (% by weight):
- 5.5% gelatin (type IV),
- 0.4% Alizarin Sapphire (Dye),
- 1 l osmosed water.

For each composition, 20 cc were sampled that were coated on a transparent terephthalate polyethylene support (Estar™ type, strip width 125 mm) using a scraper having calibrated slots, with a support traveling speed of 35 cm/s.

A temperature gradient ΔT of 10° C. was applied, for 36 seconds, with T1=10° C. and T2=20° C., at 11 successive zones, $Z_0$ to $Z_{10}$, as shown on FIG. 1. The light source 4 came from a halogen lamp, transmitted by an optical fiber. The light signal crossed the 11 zones and was recorded by a CCD camera (Photometrix™ type). The light beam is perpendicular to the support traveling direction). The thickness $H_x$ of each zone was calculated according to the formula:

$$H_x = \log(\text{Rep}) \times C_a + C_b \quad \text{(Equation 3)}$$

Then $\Delta H_m$ was calculated according to the formula:

$$\Delta H_m = \Sigma |H_{2x} - H_{2x+1}| / (n-1) \quad \text{(Equation 4)}$$

with $H_{2x}$ being the thickness of zone $Z_{2x}$, $H_{2+1}$ being the thickness of zone $Z_{2x+1}$, x being an integer and n being the number of zones. Constants $C_a$ and $C_b$ were determined in the following way: −20 cc of composition (A) were sampled and coated on a transparent terephthalate polyethylene support (Estar™ type, strip width 125 mm) using a scraper having calibrated slots, to form a layer of known thickness. This operation was carried out without a temperature gradient. Then, the signal was measured by the CCD camera. The same operation was repeated making the thickness of the formed layer vary. The results are given in Table 1.

TABLE 1

| Log (camera response) | Thickness of the formed layer (mm) |
|---|---|
| 2.628 | 0.1 |
| 2.168 | 0.2 |
| 1.740 | 0.3 |
| 1.301 | 0.4 |

Thus the calibration curve can be calculated:

$$h_x = -0.2267 \times \log(\text{Rep}) + 0.6942 \quad \text{(Equation 5)}$$

Table 2 below contains the results of the experiment for compositions (A) and (B),

TABLE 2

| | Thickness variation $\Delta H_m$ (mm) | |
|---|---|---|
| Time (s) | Composition (B) Control | Composition (A) |
| 0 | 0 | 0 |
| 4 | 0.025 | 0.005 |
| 8 | 0.035 | 0.004 |
| 12 | 0.037 | 0.004 |
| 16 | 0.036 | 0.004 |
| 20 | 0.035 | 0.003 |
| 24 | 0.033 | 0.003 |
| 28 | 0.032 | 0.003 |
| 32 | 0.030 | 0.003 |
| 36 | 0.029 | 0.003 |

Note that the use of 1% saponin (surfactant) in the composition to be coated enables defects due to the temperature gradient to be divided by a factor of 10. This surfactant can thus be selected for composition (A).

Example 2

The same experiment as in example 1 was repeated with the following compositions:

Composition (C) with the following formulation (% by weight):
- 5.5% gelatin (type IV),
- 0.4% Alizarin Sapphire (Dye),
- 1% Empilan K18 (supplied by Albright & Wilson),
- 1 l osmosed water.

Composition (B), used as control, with the following formulation (% by weight):
- 5.5% gelatin (type IV),
- 0.4% Alizarin Sapphire (Dye),
- 1 l osmosed water.

The results are given in Table 3.

TABLE 3

| Duration of the temperature gradient (s) | Thickness variation $\Delta H_m$ (mm) Composition (B) Control | Composition (C) |
|---|---|---|
| 0 | 0 | 0 |
| 4 | 0.025 | 0.030 |
| 8 | 0.035 | 0.058 |
| 12 | 0.037 | 0.075 |
| 16 | 0.036 | 0.086 |
| 20 | 0.035 | 0.092 |
| 24 | 0.032 | 0.096 |
| 28 | 0.032 | 0.099 |
| 32 | 0.030 | 0.100 |
| 36 | 0.029 | 0.101 |

Note that the use of 1% Empilan K18 (surfactant) in the composition to be coated amplified the defects due to the temperature gradient. The use of this type of surfactant was thus avoided for composition (C).

Example 3

The experiment of Example 1 was repeated. The concentration (x) of the surfactant was varied. The compositions had the following formulation (% by weight):

Composition (D) for 1 l of cyclohexanone:

x % of surfactant DC190 (supplied by Dow Corning), 0.2% of Sudan-Red dye (supplied by Aldrich), 1.6% of cellulose propionate acetate.

The results, for t=8s, t being the duration of the temperature gradient, are given in Table 4.

TABLE 4

| Concentration in surfactant (% by weight) | Thickness variation $\Delta H_m$ (mm) |
|---|---|
| 0 | 0.164 |
| 0.01 | 0.312 |
| 0.05 | 0.037 |
| 0.1 | 0.134 |
| 0.2 | 0.116 |
| 0.5 | 0.115 |
| 1 | 0.120 |
| 2 | 0.162 |

Note that for this organic solvent medium, the optimum concentration in surfactant DC190 was 0.05% for this type of composition.

PARTS LIST:

1 support
2 coating layer
3 means to apply the required temperature to the n successive zones
4 means to measure thicknesses of each zone
5 optical detection means
6 longitudinal axis
7 transparent plate

What is claimed is:

1. A method for coating a support with a layer of a composition comprising an aqueous or an organic solvent and at least a surfactant, wherein said surfactant agent has been selected by a sequence comprising the steps of:

a) after formation of said layer, applying temperatures Ti to n successive zones $Z_n$ of said layer so that a temperature gradient $\Delta T$ is created between a zone $Z_i$ and a zone $Z_{i+1}$ and the temperatures of the zones $Z_i$ and $Z_{i+2}$ are the same, wherein n is an integer representing the number of zones, i is an integer between 1 and n, and $\Delta T$ is chosen so as to create a measurable periodic variation of thickness of said layer from the $1^{st}$ to the $n^{th}$ zone;

b) measuring said thickness $H_x$ of each zone;

c) determining an average variation of said thickness $\Delta H_m$ of said layer, and d) repeating steps (a) to (c) for a control composition comprising said aqueous or said organic solvent to determine $\Delta H_m$, wherein said surfactant satisfies the following condition:

$\Delta H_m$ of said layer with said surfactant $<\Delta H_m$ for said control.

2. A method for selecting a surfactant for coating a support with a layer of a composition comprising an aqueous or an organic solvent and at least a surfactant, comprising the following steps:

a) coating said support with said composition;

b) after formation of said layer, applying temperatures Ti to n successive zones $Z_n$ of said layer, so that a temperature gradient $\Delta T$ is created between a zone $Z_i$ and a zone $Z_{i+1}$ and said temperatures of said zones $Z_i$ and $Z_{i+2}$ are the same, wherein n is an integer representing the number of zones, i is an integer between 1 and n, and $\Delta T$ is chosen so as to create a measurable periodic variation of thickness of said layer from the $1^{st}$ to the $n^{th}$ zone;

c) measuring said thickness $H_x$ of each zone;

d) determining an average variation of said thickness $\Delta H_m$ of said layer; and e) repeating steps (a) to (d) for a control composition comprising said aqueous or said organic solvent, to determine $\Delta H_m$ for said control, wherein said surfactant satisfies the following condition:

$\Delta H_m$ of the layer with the surfactant $<\Delta H_m$ for the control.

3. The method of claim 2, wherein said composition further comprises at least an optically absorbent substance and said thickness $H_x$ of each zone is measured optically by illuminating said zones with a light source.

4. The method of claim 2, wherein said support is transparent and said thickness $H_x$ of each zone is determined using a photosensitive sensor of charge-coupled device type and, wherein optical density of said each zone is measured by transmission of said each zone.

5. The method of claim 2, wherein the number of zones is more than 5, and preferably between 8 and 15.

6. The method of claim 2, wherein said layer comprises a polymeric binder.

7. The method of claim 2, wherein said composition mostly comprises an organic solvent and said temperature gradient $\Delta T$ is preferably more than or equal to 3° C.

8. The method of claim 2, wherein said composition mostly comprises an aqueous solvent and said temperature gradient $\Delta T$ is preferably more than or equal to 6° C.

9. A method of determining optimum concentration of a surfactant in a composition used for coating a layer on a support, said composition comprising an aqueous or an organic solvent, said method comprising the steps of:

a) providing m coating compositions, with m being an integer >1, each coating composition having a different concentration of said surfactant;

b) coating said each coating composition on a support and one composition per support, to obtain m separate coated supports;

c) after formation of each layer, applying temperatures Ti to n successive zones Z of said each layer, so that a temperature gradient $\Delta T$ is created between a zone $Z_i$ and a zone $Z_{i+1}$ and said temperatures of the zones $Z_i$ and $Z_{i+2}$ are the same, n being an integer, i being an integer between 1 and n, and $\Delta T$ being chosen so as to create a measurable periodic variation of thickness of each layer from the $1^{st}$ to the $n^{th}$ zone;

d) measuring said thickness $H_x$ of said each zone, and e) determining average variation of said thickness $\Delta H_m$ of said each layer, an optimum concentration of said surfactant being that of said layer which has the lowest average thickness variation $\Delta H_m$.

10. The method of claim 9, wherein said concentrations of said surfactant in the m compositions are in the range of from 0.01 to 5 weight percent based on the total weight of said compositions.

* * * * *